US007948506B2

(12) United States Patent
Cok et al.

(10) Patent No.: US 7,948,506 B2
(45) Date of Patent: May 24, 2011

(54) METHOD AND APPARATUS FOR DEFECT CORRECTION IN A DISPLAY

(75) Inventors: Ronald S. Cok, Rochester, NY (US); Paul J. Kane, Rochester, NY (US)

(73) Assignee: Global OLED Technology LLC, Herndon, VA (US)

( * ) Notice: Subject to any disclaimer, the term of this patent is extended or adjusted under 35 U.S.C. 154(b) by 796 days.

(21) Appl. No.: 11/274,467

(22) Filed: Nov. 15, 2005

(65) Prior Publication Data

US 2007/0109327 A1 May 17, 2007

(51) Int. Cl.
*G09G 5/02* (2006.01)

(52) U.S. Cl. ..... 345/694; 345/695; 345/697

(58) Field of Classification Search ..... 345/613, 345/604, 589, 596, 418, 590, 694–697; 445/4, 445/24

See application file for complete search history.

(56) References Cited

U.S. PATENT DOCUMENTS

| | | | | |
|---|---|---|---|---|
| 5,504,504 | A | 4/1996 | Markandey et al. | |
| 6,919,681 | B2 | 7/2005 | Cok et al. | |
| 2004/0222999 | A1 * | 11/2004 | Choi et al. | 345/589 |
| 2005/0179675 | A1 * | 8/2005 | Hekstra et al. | 345/204 |

FOREIGN PATENT DOCUMENTS

| | | |
|---|---|---|
| WO | WO 03/100756 | 12/2003 |
| WO | WO 2005/052902 | 6/2005 |

OTHER PUBLICATIONS

U.S. Appl. No. 10/869,009, filed Jun. 16, 2004; titled "Method and Apparatus For Uniformity And Brightness Correction In An OLED Display"; of Ronald S. Cok, James H. Ford.

U.S. Appl. No. 11/040,066, filed Jan. 21, 2005; titled "Method And Apparatus For Defect Correction In A Display"; of Ronald S. Cok.

* cited by examiner

*Primary Examiner* — Alexander Eisen
*Assistant Examiner* — Christopher E Leiby
(74) *Attorney, Agent, or Firm* — Morgan, Lewis & Bockius LLP

(57) ABSTRACT

A full-color display device, comprising: a) a display having a plurality of sub-pixels formed in rows or columns in a first dimension including at least three different color sub-pixels forming a color gamut, and grouped into pixels within each row or column, each pixel including at least two of the gamut-specifying color sub-pixels and at least one additional sub-pixel having a color within the gamut and an efficiency higher than at least one of the color sub-pixels, wherein at least one pixel is defective and comprises one defective additional in-gamut sub-pixel; and b) a controller for driving the display pixels and for transforming an input signal into a compensated signal for selectively modifying the output of at least one color sub-pixel in the defective pixel, at least one other, but not all, of the color sub-pixels in a neighboring pixel in the first dimension, and additional in-gamut sub-pixels in neighboring pixels in a second dimension, the at least one other color sub-pixel including the sub-pixel in the neighboring pixel that is closest to the defective sub-pixel, to compensate for the output of the defective sub-pixel(s).

14 Claims, 3 Drawing Sheets

METHOD AND APPARATUS FOR DEFECT CORRECTION IN A DISPLAY

FIELD OF THE INVENTION

The present invention relates to displays having a plurality of colored light-emitting elements and, more particularly, correcting for defective light-emitting elements in the display.

BACKGROUND OF THE INVENTION

Flat-panel display devices, for example plasma, liquid crystal and Organic Light Emitting Diode (OLED) displays have been known for some years and are widely used in electronic devices to display information and images. Such devices employ both active-matrix and passive-matrix control schemes and can employ a plurality of colored light-emitting elements to form a full-color, pixilated display. Each pixel comprises a plurality of colored sub-pixel light-emitting elements, for example red, green, and blue. It is also known to provide color displays with four colored sub-pixels in each pixel of a full-color display to reduce power usage, for example as taught in U.S. Pat. No. 6,919,681 by Cok et al. The light-emitting elements are typically arranged in two-dimensional arrays with a row and a column address for each light-emitting element and having a data value associated with each light-emitting element to emit light at a brightness corresponding to the associated data value. In some displays, the colored sub-pixels are formed in rows or columns of a common color; in other displays sub-pixels of the same color may be offset from each other in neighboring rows or columns.

In general, displays suffer from a variety of defects that limit their quality. In particular, displays may suffer from defective light-emitting elements that do not respond properly to control signals, for example, the defective light-emitting elements may be permanently turned on, permanently turned off, be brighter, and/or be dimmer than intended for a given control signal. These non-uniformities can be attributed to the light-emitting or light-controlling materials in the display or, for active-matrix displays, to variability in the thin-film transistors used to drive the light emitting elements. Moreover, applicants have determined through experiments that defective light-emitting elements vary in the accuracy of their response at different brightness levels so that a light-emitting element may have a more accurate response at some light levels than at others. In other words, a pixel may be defective at one light level but less defective or not defective at all at another light level. Furthermore, most displays are color displays having pixels with three or four colored light-emitting elements and defects may be found in one color light-emitting element of a display pixel but not in the other color light-emitting elements of the same pixel. Such defects reduce the quality, reduce the manufacturing yields, and increase the costs of flat-panel displays.

A variety of schemes have been proposed to correct for non-uniformities in displays. Many such schemes are addressed to improving the uniformity of the light-emitting elements, for example, copending, commonly assigned U.S. Ser. No. 10/869,009, filed Jun. 16, 2004, describes providing an OLED display having a plurality of light-emitting elements with a common power signal and local control signals; providing a digital input signal for displaying information on each light-emitting element, the signal having a first bit depth; transforming the digital input signal into a transformed digital signal having a second bit depth greater than the first bit depth, and correcting the transformed signal for one or more light-emitting elements of the display by applying a local correction factor to produce a corrected digital signal. However, such uniformity correction schemes may not sufficiently correct for display devices having defective light-emitting elements that are stuck on or stuck off, or that are not sufficiently responsive to control signals to perform the desired correction.

Copending, commonly assigned U.S. Ser. No. 11/040,066, filed Jan. 21, 2005, describes a further correction method for compensating output of defective light-emitting elements in a display. Referring to FIG. 5, e.g., in a specific embodiment discussed therein a display having pixels 38 with sub-pixels 30, 32, and 34 forming a color gamut (e.g. red, green, blue), a defective sub-pixel 20 may be compensated by driving the nearest sub-pixels of a common color (22, 24, 26, 28). However, such an approach often creates visible spatial artifacts because of the distance between the sub-pixels of a common color.

Some further correction methods for masking stuck light-emitting elements in a display are known. For example, WO/2005/052902 describes a method for reducing the visual impact of defects present in a matrix display comprising a plurality of pixels, said pixels comprising at least three sub-pixels, each sub-pixel intended for generating a sub-pixel color which cannot be obtained by a linear combination of the sub-pixel colors of the other sub-pixels of the pixel, the method comprising: providing a representation of a human vision system, characterising at least one defect sub-pixel present in the display, the defect sub-pixel intended for generating a first sub-pixel color, the defect sub-pixel being surrounded by a plurality of non-defective sub-pixels, deriving drive signals for at least some of the plurality of non-defective sub pixels in accordance with the representation of the human vision system and the characterising of the at least one defect sub-pixel, to thereby minimise an expected response of the human vision system to the defect sub-pixel, and driving at least some of the plurality of non-defective sub-pixels with the derived drive signals, wherein minimising the response of the human vision system to the defect sub-pixel comprises changing the light output value of at least one non-defective sub-pixel for generating another sub-pixel color, said another sub-pixel color differing from said first sub-pixel color. The invention also provides a corresponding system for reducing the visual impact of defects present in a matrix display, and a matrix display with reduced visual impact of defects present in the display. However, there is no teaching with respect to optimal correction for defective pixels in systems in which combinations of sub-pixels can generate a color found in an other sub-pixel, for example as taught in U.S. Pat. No. 6,919,681 referenced above.

WO2003100756 addresses issues found with displays having at least one redundant sub-pixel. This application describes a method for masking faulty sub-pixels in a display having a plurality of pixels formed of a number of sub-pixels, wherein at least one pixel in said display is faulty and comprises at least one sub-pixel having a defect. The method comprises obtaining a set of sub-pixel values for generating desired perceptive characteristics for said pixel and determining a modified set of sub-pixel values for generating modified perceptive characteristics for said pixel. This modified set of sub-pixel values is based on information regarding the sub-pixel defect so as to be implementable in the display, and has values chosen to reduce an error perceived by a user. The modified values are then implemented in the display. The display is preferably of the kind where each pixel comprises a set of primary sub-pixels each emitting a primary color and at least one additional, redundant sub-pixel for emitting an additional color, such as a RGBW display. The disclosure includes a reference that the optimization problem can also be extended to include the distance to surrounding sub-pixels, but no solutions are taught. Referring to FIG. 6, in a prior-art illustration, a display having pixels 35 with sub-pixels 30, 32, and 34 forming a color gamut (e.g. red, green, blue), with an in-gamut sub-pixel 36, a defective in-gamut sub-pixel 40 may be compensated by driving the color sub-pixels 50, 52, and 54 of the same pixel 58. However, in this design, the spatial extent of the corrected light-emitting elements is not optimized, and is thus more visible than may be necessary.

There is a need, therefore, for an improved display that compensates for defective light-emitting elements in a full-color display.

SUMMARY OF THE INVENTION

The present invention is directed towards a full-color display device, comprising: a) a display having a plurality of sub-pixels formed in rows or columns in a first dimension including at least three different color sub-pixels forming a color gamut, and grouped into pixels within each row or column, each pixel including at least two of the gamut-specifying color sub-pixels and at least one additional sub-pixel having a color within the gamut and an efficiency higher than at least one of the color sub-pixels, wherein at least one pixel is defective and comprises one defective additional in-gamut sub-pixel; and b) a controller for driving the display pixels and for transforming an input signal into a compensated signal for selectively modifying the output of at least one color sub-pixel in the defective pixel, at least one other, but not all, of the color sub-pixels in a neighboring pixel in the first dimension, and additional in-gamut sub-pixels in neighboring pixels in a second dimension, the at least one other color sub-pixel including the sub-pixel in the neighboring pixel that is closest to the defective sub-pixel, to compensate for the output of the defective sub-pixel(s).

ADVANTAGES

In accordance with various embodiments, the present invention may provide the advantage of improved uniformity and quality in a display with improved power efficiency, and improve manufacturing yields.

DETAILED DESCRIPTION OF THE INVENTION

Figure 1A:
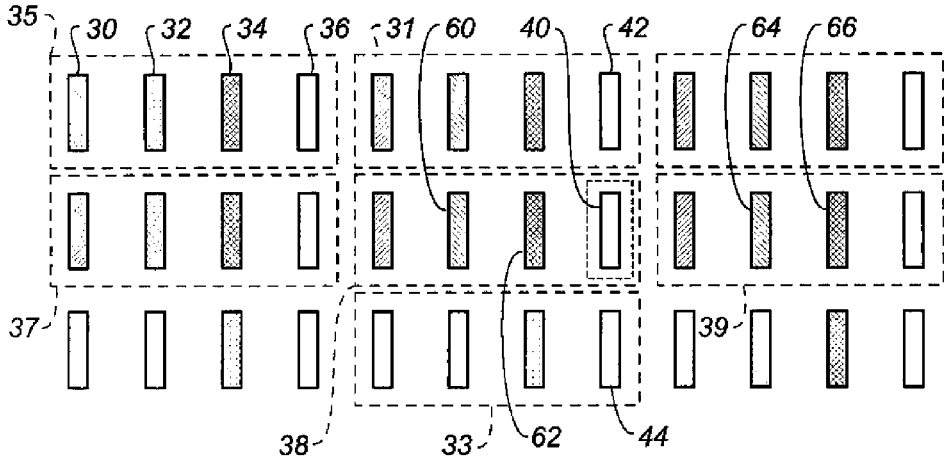
FIG. 1*a* is a schematic diagram of color sub-pixels arranged in columns according to one embodiment of the present invention.
Figure 2:
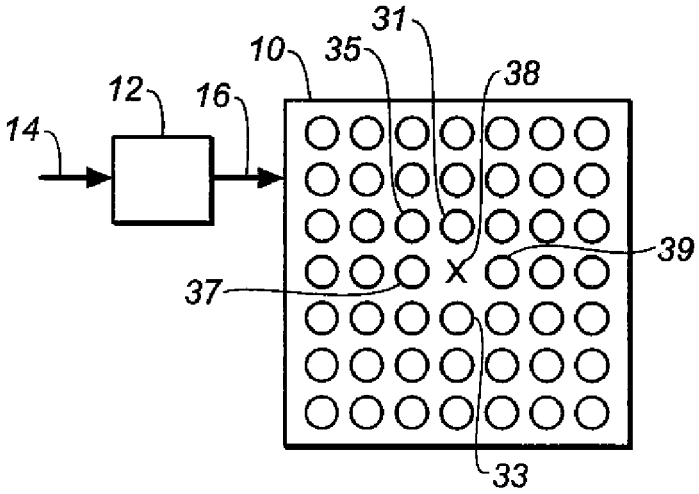
FIG. 2 is a schematic diagram of a display system according to another embodiment of the present invention.

Referring to FIG. 1*a*, in an embodiment of the present invention, a full-color display device comprises a display having a plurality of sub-pixels (e.g., 30, 32, 34, 36, 40, 42, 44, 60, 62, 64, and 66) formed in rows in a first dimension and grouped into pixels (e.g., 31, 33, 35, 37, 38, and 39) within each row, each pixel including at least three color sub-pixels (e.g. red 30, 64, green 32, 60, and blue 34, 62) forming a color gamut and at least one additional sub-pixel (e.g. 36, 40, 42, 44) having a color within the gamut and an efficiency higher than at least one of the color sub-pixels wherein at least one pixel (e.g., 38) is defective and comprises one defective additional in-gamut sub-pixel (e.g., 40). Referring to FIG. 2, a controller 12 for driving the display 10 pixels and for transforming an input signal 14 into a compensated signal 16 for selectively modifying the output of at least one color sub-pixel in the defective pixel 38, at least one other, but not all, of the color sub-pixels in a neighboring pixel (e.g. 37, 39) in the first dimension, and additional in-gamut sub-pixels in neighboring pixels (e.g. 31, 33) in a second dimension, the at least one other color sub-pixel including the sub-pixel (64 in FIG. 1*a*) in the neighboring pixel 39 that is closest to the defective sub-pixel 40, to compensate for the output of the defective sub-pixel. As illustrated in FIG. 1*a*, the first dimension in which the sub-pixels are formed into pixels is in the horizontal row direction while the second dimension is in the vertical column direction, but these conventions may be reversed within the present invention.

In operation, the defective sub-pixel 40 does not respond appropriately to the input signal 14, so that the input signal 14 must be processed by the controller 12 to provide a compensated signal 16 so that, in order to provide the desired luminance and/or chrominance of the display device 10 in the local area surrounding the defective sub-pixel 40, the output of color sub-pixels 64 and 66 in neighboring pixel 39 is modified to compensate for the output of the defective pixel 40. In order to minimize spatial non-uniformity and to provide the desired luminance and chrominance, the output of at least one color sub-pixel in the defective pixel, at least one other, but not all, of the color sub-pixels in a neighboring pixel in the first dimension, are selectively modified, together with additional in-gamut sub-pixels in neighboring pixels in the second dimension, where the at least one other color sub-pixel in the neighboring pixel is closest to the defective sub-pixel. Sub-pixel 64, e.g., is closest to the defective sub-pixel 40, and its output is selectively modified to minimize the spatial non-uniformity of the compensation. By not employing all of the color sub-pixels in the neighboring pixel, and instead employing a combination of color sub-pixels in the defective and neighboring pixels, the color sub-pixels spatially closest to the defective sub-pixel are employed, thereby maximizing spatial uniformity. The output of sub-pixels 60 and 62 within the defective pixel are also selectively modified to maintain the overall luminance and chrominance of the local area around the defective in-gamut sub-pixel 40. The brightness of additional in-gamut sub-pixels 42 and 44 in neighboring pixels 31, 33 respectively are also selectively modified; their use decreases the power used by the display and also reduces spatial non-uniformity in compensating for defective pixel 40. The defective sub-pixel 40 is shown surrounded by a darkened rectangle to illustrate a defective light-emitting element. Pixel groups are shown in a dashed rectangle to clarify the description of the present invention.

According to the present invention, the pixels are formed in rows or columns to enable a simple and low-cost manufacturing process. In one preferred embodiment, the sub-pixels are formed in ordered stripes of red, green, blue, and white light-emitting elements, providing a simple layout and good image quality, particularly for graphics and text. Other orderings may be employed, for example blue, green, red, and white. In both these orderings, the relatively higher luminance green and white emitting elements are spaced between the relatively lower luminance red and blue emitting elements, which may be preferred. Alternatively, the aligned rows or columns of sub-pixels of common colors in the second dimension may be sequentially aligned such that the green and white emitting elements are adjacent (e.g., in the order: red, blue, green, white; blue, red, green, white; red, blue, white, green; or blue, red, white, green).

The sub-pixels may be under active-matrix or passive-matrix control, as is known in the art. The formation of pixels and sub-pixels with patterned emitters or color filters with patterned white emitters is known in the art. In this arrangement, white sub-pixels are the additional in-gamut sub-pixels and one such white sub-pixel is illustrated as the defective in-gamut sub-pixel 40 of FIG. 1*a*. Sub-pixel 60 emits green light and sub-pixel 62 emits blue light. Sub-pixel 64 and 66 are formed on the other side of the defective sub-pixel 40 in neighboring pixel 39 and formed in the same row as the pixel 38 containing defective sub-pixel 40. Sub-pixel 64 emits red light and sub-pixel 66 emits green light.

To provide a compensating signal 16 to maintain the luminance and chrominance of the display 10, the controller 12 selectively modifies the brightness of the red and blue sub-pixels 64 and 62 to provide the amount of red and blue light that is missing because of the defective in-gamut sub-pixel 40. The controller 12 also selectively modifies the brightness of the green sub-pixels 60 and 66 to provide the amount of green light that is missing because of the defective in-gamut sub-pixel 40. Because two green sub-pixels are present, they may each provide one half of the necessary light, thus maintaining a spatially balanced compensation. In this case, the amount of selectively modified light provided by the more distant color sub-pixel 60, green, is smaller than that provided by the blue sub-pixel 62 on one side of the defective sub-pixel 40 and the amount of selectively modified light provided by the more distant color sub-pixel 66, green, is smaller than that provided by the red sub-pixel 64 on the other side of the defective sub-pixel 40 because two color sub-pixels (60, 66) farthest from the defective in-gamut sub-pixel are the same color (green). The additional, in-gamut sub-pixels 42 and 44 also provide some fraction of the compensating light emission. For example, let R, G and B denote the intensities of the red, green and blue sub-pixels respectively, where $0 \leqq R \leqq R_{max}$, and G and B are similarly constrained. Let W denote the intensity of the white subpixel. The intensities $R_{max}$, $G_{max}$, and $B_{max}$, are chosen such that $R_{max}=G_{max}=B_{max}$ matches the color produced by $W=W_{max}$. Suppose that the display input data requires that $W=W_0$, and wherein $R_0$, $G_0$, $B_0$ combined equal $W_0$ for pixel 38. However the W sub-pixel is defective so that its output is equivalent to W =0. Therefore, a compensating signal of $R_0/2$, $G_02$, $B_02$, $W_1=W/4$, and $W_2=W/4$ must be applied to the surrounding subpixels (where $W_1$ and $W_2$ are the additional in-gamut sub-pixels 42 and 44 in neighboring pixels 31 and 33, and wherein the color triplet provides a colorimetric match to $W_0$). The green compensating signal $G_0/2$ is divided between the more distant green color sub-pixels 60 and 66, and each of the more distant green color sub-pixels receives a compensating signal $G_0/4$, while the red sub-pixel 64 and blue sub-pixel 62 receive the compensating signals $R_0/2$ and $B_0/2$, respectively.

Because red, green, and blue light form the color gamut of the output light, the desired chrominance and luminance of the display in the area surrounding the defective in-gamut sub-pixel is provided while minimizing the spatial non-uniformity of the display. Employing the in-gamut sub-pixels (42, 44) assists in sharing the additional light output thereby improving the power usage, dynamic range, and lifetime of the display.

In the above specific example, one-half of the difference in desired luminance is compensated by the in-gamut additional sub-pixel(s) and one-half of the difference in desired luminance is compensated by the color sub-pixels. In an alternative example, two-thirds of the difference in desired luminance may be compensated by the in-gamut additional sub-pixel(s) and one-third of the difference in desired luminance compensated by the color sub-pixels (e.g., a compensating signal of $R_0/3$, $G_0/3$, $B_0/3$, $W_1=W/3$, and $W_2=W/3$ may be applied to the surrounding subpixels), or further alternatively one-third of the difference in desired luminance may be compensated by the in-gamut additional sub-pixel(s) and two-thirds of the difference in desired luminance compensated by the color sub-pixels (e.g., a compensating signal of $2R_0/3$, $2G_0/3$, $2B_0/3$, $W_1=W/6$, and $W_2=W/6$ may be applied to the surrounding subpixels).

It is also possible to selectively employ color sub-pixels in neighboring pixels (e.g. 35, 31, 33) to further provide light and reduce aging and provide more uniform luminance and chrominance, at the cost of increasing the spatial extent of the compensation. Those color sub-pixels directly above color sub-pixels 60, 62, 64, and 66 may be employed thusly.

Figure 1B:
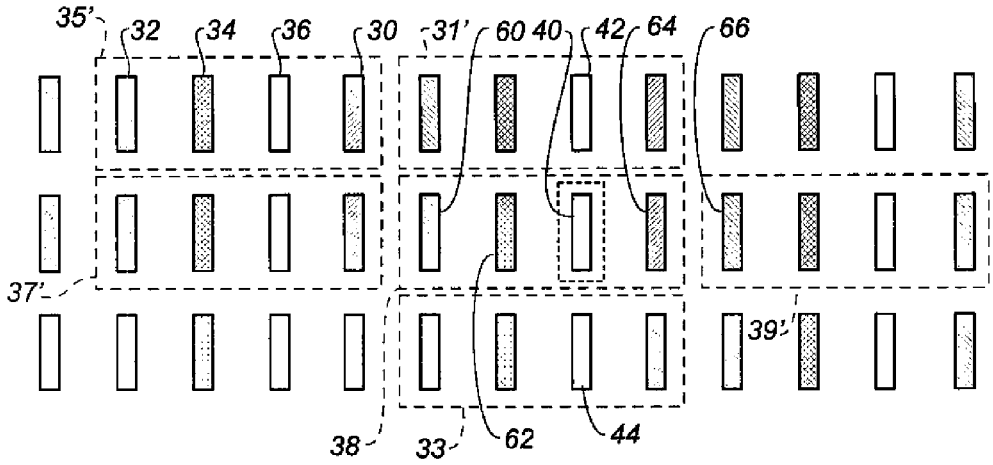
FIG. 1*b* is a schematic diagram corresponding to FIG. 1*a* with different sub-pixel organizations.

Although the description of the present invention is described above with pixels formed in rows and having columns of sub-pixels with common color, by rotating the display 90 degrees the rows can be exchanged with columns. Hence, the pixels can be considered to be formed in rows or columns and the present invention includes both embodiments. Moreover, in such a stripe pattern, the definition of pixel may be somewhat arbitrary. Referring to FIG. 1*b*, the pixels are shifted over by one sub-pixel while the sub-pixel arrangement is unchanged. In this embodiment, the sub-pixel 66 is in pixel 39' while the color sub-pixels 60, 62, and 64 are in pixel 38'. Additional, in-gamut sub-pixels 42 and 44 are in pixels 31' and 33' and are selectively modified in the same way. Hence, at least one color sub-pixel in the defective pixel 38' is selectively modified, at least one other, but not all, of the color sub-pixels in neighboring pixel 39' in the first dimension, and additional in-gamut sub-pixels 42, 44 in neighboring pixels 31', 33' in the second dimension, the at least one other color sub-pixel including the sub-pixel 64 in the neighboring pixel 39 that is closest to the defective sub-pixel 40, are selectively modified to compensate for the output of the defective sub-pixel 40.

Figure 3:
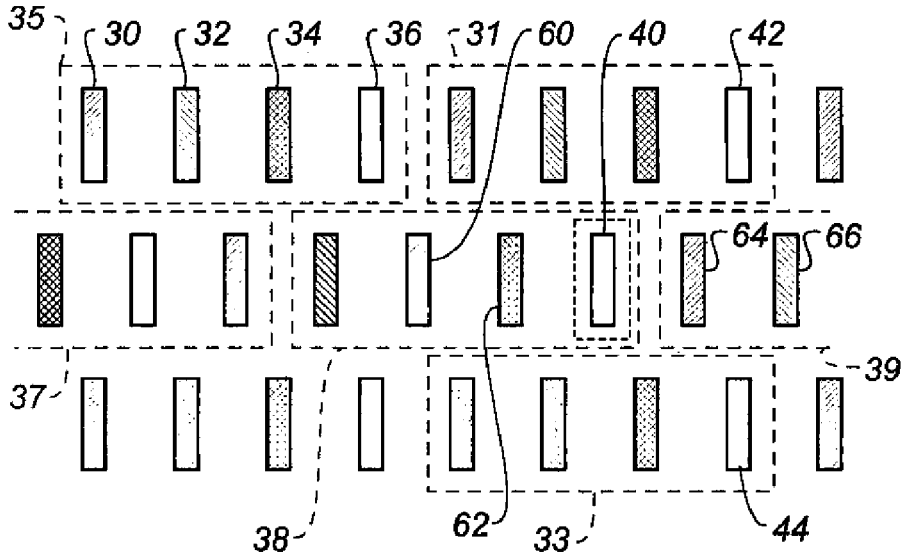
FIG. 3 is a schematic diagram of color sub-pixels arranged in offset rows according to another embodiment of the present invention.

As illustrated in FIGS. 1*a* and 1*b*, the sub-pixels of each pixel are formed in rows or columns having a common color of sub-pixel, i.e. in stripes. Referring to FIG. 3, in an alternative embodiment of the present invention, the sub-pixels of each pixel are formed in rows or columns that are offset from neighboring rows or columns. In this embodiment, the defective in-gamut sub-pixel 40 may be compensated by selectively modifying the light output from the green and blue color sub-pixels 60 and 62 in pixel 38 and the red and green color sub-pixels 64 and 66 in neighboring pixel 39 to provide the amount of red, green, and blue light that is missing because of the defective in-gamut sub-pixel 40. As noted above in regard to the embodiment of FIG. 1*a*, neighboring in-gamut sub-pixels, (i.e.. the white sub-pixels 42 and 44) in rows above and/or below the row containing the defective sub-pixel 40 are employed to replace some of the missing white light, improve spatial uniformity, and reduce power usage. Employing these in-gamut sub-pixels assists in sharing the additional light output thereby improving the dynamic range and lifetime of the display. It is also possible to employ color sub-pixels in neighboring pixels to further provide light and reduce aging and provide more uniform luminance and chrominance, at the cost of increasing the spatial extent of the compensation.

Figure 4:
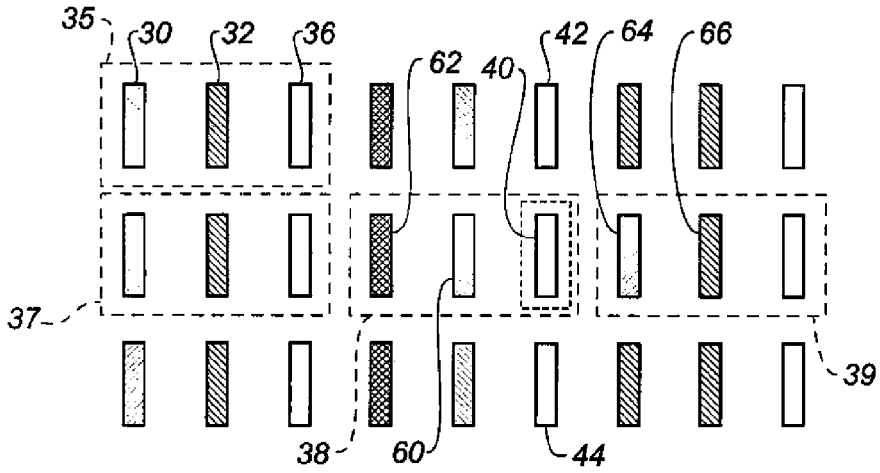
FIG. 4 is a schematic diagram of a display system having subsampled color sub-pixels according to another embodiment of the present invention.
Figure 5:
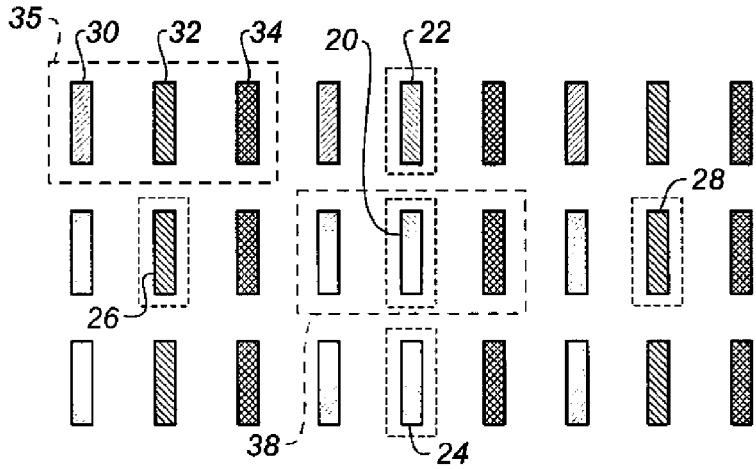
FIG. 5 is an illustration of a comparison compensation method for pixels having three gamut-specifying sub-pixels.
Figure 6:
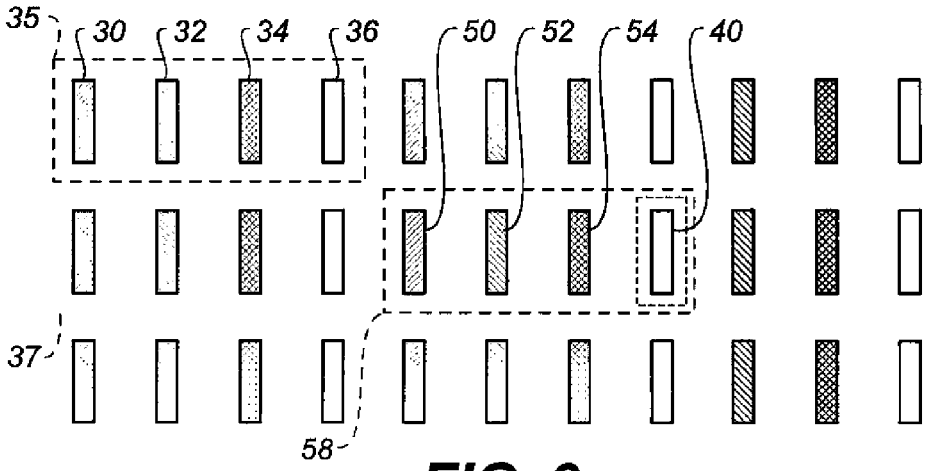
FIG. 6 (PRIOR ART)
FIG. 6 is a prior-art illustration of a compensation method for pixels having an in-gamut fourth sub-pixel.

The sub-pixel arrangements in FIGS. 1*a*, 1*b*, and 3 are examples only. It is possible, within the present invention, to re-order the sub-pixel light-emitting elements within the pixel to change the visual characteristics of the display, for example by locating the white sub-pixel immediately adjacent to the green sub-pixel. Alternatively, pixels may have multiple, identical sub-pixels (for example repeated white or green sub-pixels) while other sub-pixels (for example red or blue) may be sampled less frequently (e.g., alternating pixels may be provided in the first dimension that include different pairs of two of the gamut-specifying color sub-pixels). Such arrangements may optimize the luminance of the display or take advantage of the human visual system's decreased response to color non-uniformities. For example, referring to FIG. 4, the display has sub-pixels located in rows to form pixels wherein every other pixel has a red sub-pixel and the other pixels have a blue sub-pixel (i.e., the alternating pixels comprise a first pixel comprising red, green, and white sub-pixels, and a second pixel comprising blue, green, and white sub-pixels). In this case, the compensation signal may selectively modify the output of one color sub-pixel (e.g. red) in a neighboring pixel and two color sub-pixels (e.g. green and blue) in the defective pixel to compensate for the output of the defective sub-pixel(s).

In various embodiments of the present invention, the compensated signal drives one or more non-defective sub-pixel(s) to be dimmer for a given signal to compensate for the defective sub-pixel or alternatively, the compensated signal may drive one or more non-defective sub-pixel(s) to be brighter for a given signal to compensate for the defective sub-pixel. The former embodiment may be particularly useful when a defective sub-pixel is stuck on (forming a bright dot). The latter embodiment may be particularly useful when a defective sub-pixel is stuck off (forming a dark dot).

The present invention provides an advantage in masking the effects of defective sub-pixels by minimizing the spatial extent of the compensation while maintaining the luminance and chrominance of a display device have in-gamut pixels with sub-pixels formed in a row or column.

The display 10 of the present invention may be any flat-panel display, including an OLED display, an LCD display, or a plasma display.

To determine the defective sub-pixel(s) 40, the display 10 may be first driven by the controller 12 with a pre-determined signal. Each sub-pixel is examined and the light output measured. Means for measuring the light output from the pixels in a display are known and described in, for example co-pending, commonly assigned U.S. Ser. No. 10/858,260 (Kodak Docket 88142) and in US20040213449 entitled "Method and apparatus for optical inspection of a display", the disclosures of which are incorporated by reference herein. Once the light output from each pixel in a display is measured, a compensation signal is calculated for driving sub-pixels neighboring the defective sub-pixel(s) 40 in the display 10 to compensate for the defective sub-pixel(s) 40. The display 10 is then driven with the compensated signal.

More generally, a display device 10 according to the present invention will receive an input signal 14, transform the input signal 14 to compensate for the defective sub-pixel(s) in the display 10, and drive the display with the transformed signal 16. The measured light output from each pixel is used to derive a transformation for an arbitrary input signal. As input signals 14 are supplied to the controller 12, they are transformed into signals 16 that compensate for the defective sub-pixel(s) 40 in the display 10. Because the defective pixel(s) 40 may be stuck on or stuck off, the compensation involves driving various combinations of neighboring sub-pixel(s). The input, transform, output and drive process is then repeated for subsequent display frames. For example, a time-sequential stream of video images may be input, transformed, and then applied to the display to compensate for defective sub-pixel(s) 40 in the display 10.

A wide variety of pixel defects are known in the art, and may include pixels whose response to a given signal is lower than desired (dim pixels), brighter than desired (bright pixels), stuck on (pixels permanently turned on at some brightness regardless of signal), or stuck off (dark pixels). The response of a defective pixel may vary according to the signal provided, so that the defects may be signal dependent. Some defective pixels will respond to a signal, the response of other defective pixels will be fixed regardless of signal. Moreover, the visibility of a defect may depend on viewing distance and display resolution, so that compensation may be application dependent, or depend upon the display design, resolution, or viewing distance.

A wide variety of transformations may be employed to compensate for defective pixels. The choice of transformation will depend on the nature of the defects, the severity of the defects, the type of imagery displayed, and the nature of the display application. In particular, the resolution and viewing distance may determine the type of compensation provided. For example, at a relatively high resolution or large viewing distance, the spatial extent of the image signal compensation may be larger while at a relatively low resolution the spatial extent may be reduced.

It is also possible, and may be preferred, to provide different compensations at different brightness levels. Applicants have determined that the visibility of a defect may depend, in part, on the average brightness of the display or local area in which the defective sub-pixel is present. Hence, a different compensation scheme may be employed depending on the average brightness of the display or the local area surrounding a defective sub-pixel. In general, at a high resolution or large viewing distance it is preferred that any compensation maintain the average brightness of the display at each brightness level, since the eye is very sensitive to changes in brightness over an area. However, for some signal types having edges for example, a large-scale change in brightness in one portion of the display is contrasted with another portion. If the defective sub-pixel is on the edge, it may be more useful to modify the output of the neighboring additional sub-pixel(s) to match that of the defective pixel, or to at least modify the output of the neighboring additional sub-pixel(s) to be closer to the output of the defective sub-pixels. The compensation may also be dependent on the image content, for example if an edge is present in the image, it may be preferred to select a compensation signal that limits the changes in sub-pixel brightness to maintain a sharp edge.

In another embodiment of the present invention, the defective in-gamut sub-pixel may only be partially responsive to a control signal and may be driven in combination with neighboring sub-pixels as taught above to minimize a viewer's perception of the defective sub-pixel 40. If a sub-pixel is partially responsive to a signal, then means known in the art for uniformity correction may be employed to correct the output from the sub-pixel. However, for dim sub-pixels, such corrections often drive a neighboring defective sub-pixel much harder than the neighboring, good sub-pixels. Thus, the lifetime of the display is reduced because the defective sub-pixel will fail first. According to another embodiment of the present invention, such partially responsive defective sub-pixels may be driven in combination with one or more additional sub-pixels to compensate for the defect. By compensating both the good and defective sub-pixels, the good sub-pixels may not be driven as hard, thereby extending the lifetime of the display. If a sub-pixel is not responsive to a signal at all, then the only compensation available may be provided by driving one or more neighboring sub-pixels to modify their light output, as taught herein.

Means for providing signal transformation in a controller are known in the art and can employ well-known hardware for image processing, in particular spatial filters applied to specific sub-pixels, scaling electronics, look-up tables, and the like.

The invention has been described in detail with particular reference to certain preferred embodiments thereof, but it will be understood that variations and modifications can be effected within the spirit and scope of the invention.

PARTS LIST

10 display
12 controller
14 input signal
16 compensated signal
20 defective sub-pixel
22, 24, 26, 28 sub-pixel
30 red sub-pixel
31, 31' pixel
32 green sub-pixel
33, 33' pixel
34 blue sub-pixel
35, 35' pixel
36 white sub-pixel
37, 37' neighboring pixel
38, 38' pixel having defective sub-pixel
39, 39' neighboring pixel
40 defective white sub-pixel
42 neighboring white sub-pixel
44 neighboring white sub-pixel
50, 52, 54 color sub-pixel
60 green sub-pixel
62 blue sub-pixel
64 red sub-pixel
66 green sub-pixel

What is claimed is:

1. A full-color display device, comprising:

a) a display having a plurality of pixels formed in rows, each pixel including at least red, green, blue color sub-pixels and a white subpixel formed within each row, wherein the white sub-pixel has an efficiency greater than at least one of the color sub-pixels, and wherein at least one white sub-pixel is defective, resulting in at least one defective pixel; and b) a controller for driving the display pixels and for transforming an input signal into a compensated signal for selectively modifying the output of:

at least one color sub-pixel in the defective pixel, at least one other, but not all, of the color sub-pixels in a neighboring pixel in the row containing the defective pixel, and only a white subpixel(s) in neighboring pixels in rows that are above or below the row containing the defective pixel, the at least one other color sub-pixel including the color subpixel in the neighboring pixel that is closest to the defective white sub-pixel, to compensate for the output of the defective sub-pixel(s) in order to maintain a desired luminance and/or chrominance of the display device, wherein the defective sub-pixel provides more or less luminance than desired and wherein a first fraction of a difference in desired luminance and the luminance provided by the defective sub-pixel is compensated by the white subpixel(s), and a second fraction of the difference in desired luminance and the luminance provided by the defective sub-pixel is compensated by the color sub-pixel(s).

2. The display device of claim 1, wherein the output of at least two color sub-pixels in the defective pixel or at least two color sub-pixels in the neighboring pixel in the first row are selectively modified.

3. The display device of claim 1, wherein the output of at least two color sub-pixels in the defective pixel and at least two color sub-pixels in the neighboring pixel in the first row are selectively modified.

4. The display device of claim 1, wherein at least one of the selectively modified color sub-pixels has a different distance to the defective white sub-pixel than at least one of the other selectively modified color sub-pixels and the two selectively modified color sub-pixels farthest from the defective-white sub-pixel are the same color.

5. The display device of claim 3, wherein at least one of the selectively modified color sub-pixels has a different distance to the defective white sub-pixel than at least one of the other selectively modified color sub-pixels and wherein the output of the selectively modified color sub-pixel closest to the defective white sub-pixel is selectively modified more than the output of selectively modified color sub-pixels farther from the defective white pixel than the selectively modified color sub-pixel closest to the defective white sub-pixel.

6. The display device of claim 1 wherein sub-pixels having a common color are aligned in ordered stripes.

7. The display device of claim 6 wherein the subpixels are sequentially aligned in the order red, green, blue, white or in the order blue, green, red, white.

8. The display device of claim 6 wherein the subpixels are sequentially aligned in the order: red, blue, green, white; blue, red, green, white; red, blue, white, green; or blue, red, white, green.

9. The display device of claim 1 wherein the pixels formed in the first-row are offset from neighboring pixels in the neighboring rows.

10. The display device of claim 1 wherein the compensated signal drives one or more sub-pixel(s) to be dimmer for a given signal to compensate for the defective sub-pixel.

11. The display device of claim 1 wherein the compensated signal drives one or more sub- pixel(s) to be brighter for a given signal to compensate for the defective sub-pixel.

12. The display device of claim 1 wherein the first fraction is one-half and the second fraction is one-half

13. The display device of claim 1 wherein the first fraction is two-thirds and the second fraction is one-third.

14. The display device of claim 1 wherein the first fraction is one-third and the second fraction is two-thirds.

* * * * *